US006435537B2

(12) United States Patent
Veux

(10) Patent No.: US 6,435,537 B2
(45) **Date of Patent: *Aug. 20, 2002**

(54) DEVICE FOR COUPLING A SHOE WITH A SPORTS GEAR

(75) Inventor: Jean-Luc Veux, Rumilly (FR)

(73) Assignee: Salomon S.A., Metz-Tessy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/423,319

(22) PCT Filed: Mar. 5, 1999

(86) PCT No.: PCT/FR99/00502

§ 371 (c)(1),
(2), (4) Date: Nov. 12, 1999

(87) PCT Pub. No.: WO99/47219

PCT Pub. Date: Sep. 23, 1999

(30) Foreign Application Priority Data

Mar. 19, 1998 (FR) ..... 98 03646

(51) Int. Cl.[7] ..... A63C 9/18

(52) U.S. Cl. ..... 280/615; 280/613; 280/614; 280/617

(58) Field of Search ..... 280/615, 617, 280/618, 620, 619, 621, 622, 611, 613, 614; 36/117.2, 117.1

(56) References Cited

U.S. PATENT DOCUMENTS

| | | | | | |
|---|---|---|---|---|---|
| 2,764,418 | A | * | 9/1956 | Shimizu | 280/614 |
| 4,135,734 | A | * | 1/1979 | Salomon | 280/618 |
| 4,273,355 | A | * | 6/1981 | Storandt | 280/614 |
| 4,282,660 | A | * | 8/1981 | Hanson | 36/117.1 |
| 4,659,103 | A | * | 4/1987 | Tessaro | 280/615 |
| 4,836,572 | A | * | 6/1989 | Pozzobon | 280/613 |
| 4,915,406 | A | * | 4/1990 | Graillat | 280/615 |
| 5,671,941 | A | * | 9/1997 | Girard | 280/615 |
| 5,794,963 | A | | 8/1998 | Girard | 280/615 |
| 5,897,127 | A | * | 4/1999 | Haughlin | 280/615 |
| 5,957,478 | A | * | 9/1999 | Vigny | 280/615 |
| 5,992,873 | A | * | 11/1999 | Haughlin | 280/615 |
| 6,017,050 | A | | 1/2000 | Girard | 280/615 |

FOREIGN PATENT DOCUMENTS

| | | |
|---|---|---|
| FR | 2738158 | 3/1997 |
| WO | WO 96/23558 | 8/1996 |

* cited by examiner

*Primary Examiner*—Robert P. Olszewski
*Assistant Examiner*—James S. McClellan
(74) *Attorney, Agent, or Firm*—Greenblum & Bernstein, P.L.C.

(57) ABSTRACT

A system for binding a shoe to a sports gear, such as a cross-country ski, using a fixing device fixed on the sports gear and including a stop cooperating with the shoe front end and an elastic catch cooperating with the sole associated catch arranged behind the sole front end and exerting on the sole a tension pressure towards the stop. The elastic catch is anchored on the fixing device, at the rear of the stop. The elastic catch and anchoring mechanism are longitudinally mobile countering the elastic mechanism.

17 Claims, 5 Drawing Sheets

10
70
20
1

DEVICE FOR COUPLING A SHOE WITH A SPORTS GEAR

CROSS REFERENCE TO RELATED APPLICATIONS

The present application is a continuation prosecution application (CPA) of U.S. application Ser. No. 09/423,319, filed Nov. 12, 1999, which is a U.S. National Stage under 35 U.S.C. 371 of PCT/FR99/00502, filed Mar. 5, 1999, not published under PCT Article 21(2) in English. The present application also claims priority under 35 U.S.C. § 119 of French Patent Application No. 98.03646 filed on Mar. 19, 1998.

BACKGROUND OF THE INVENTION

1. Field of the Invention

The instant invention concerns a system for fixing a shoe to a sports gear, especially a gliding sport, such as cross-country skiing, touring, telemark skiing, ice skating or roller skating.

2. Description of Background and Relevant Information

In traditional fixing systems, i.e., bindings, of the type used in cross-country skis, the fastening of the shoe on the sports gear is generally obtained at the front thereof by means of a hinge type of coupling which allows the shoe to have a clearance with respect to the sports gear, i.e., the heel can be lifted.

Ice skates or roller skates are also known to possess a journalled coupling of the shoe with the sports gear, thereby allowing the stride to be lengthened and the speed to be increased.

Such coupling systems have proven themselves. However, their drawback is that the shoe sole has to be both rigid in the transverse direction and during torsion, while also remaining flexible enough to allow, insofar as possible, the foot to move naturally.

Since these requirements are contradictory and difficult to reconcile on one single element, the ski is not always controlled and guided in an optimum manner.

On the other hand, shoes belonging to such systems generally comprise a transverse axis located at the sole front end which can become a hindrance while walking.

Identical problems are encountered in other fields, especially skating.

Document WO 96/23558 proposes coupling the shoe front part, up to the zone known as the metatarsophalangian joint, by means of an elastic element anchored at one end to the fixing element, and that is fastened, by its free end in the shoe sole, at the rear of the zone. This elastic element provides the shoe with the desired stiffness characteristics transversely and in torsion, and at the same time exerts a constant return force of the shoe towards the sports gear. The result is an improved control and guidance of the sports gear.

Nonetheless, this elastic element is subjected to substantial fatigue and rapid wear due to the repeated bending of the foot during the sporting activity, such that the stiffness and elastic return properties indicated hereinabove become altered over time.

SUMMARY OF THE INVENTION

The object of the instant invention is to overcome these drawbacks and propose an improved fixing device that reconciles the problems of the lifting of the shoe heel, torsional control and material fatigue.

This object is achieved in the fixing device of the system according to the invention which is of the type comprising a front stop cooperating with the shoe front end, and an elastic catch cooperating with the sole associated catch arranged behind the sole front end, and exerting on the sole a tension pressure towards the stop, due to the fact that the elastic catch is anchored on the fixing device at the rear of the front stop.

This construction leads to a substantial reduction in the bending stresses of the elastic catch which, as a result, is less prone to wear by reason of fatigue, and furthermore exerts a more constant tension pressure and elastic return pressure.

According to a preferred embodiment, the anchoring mechanism of the elastic catch is longitudinally mobile countering the elastic mechanism. This construction guarantees that when the shoe bends, the return elasticity will preferably be provided by the compression of the elastic mechanism rather than by the bending of the catch. Consequently, the return elasticity can be better controlled.

Also, the anchoring of the elastic catch is advantageously constituted by a journal, which allows it to remain completely free of any bending related energy.

BRIEF DESCRIPTION OF THE DRAWINGS

The invention will be better understood and other characteristics thereof shall become more apparent from the description that follows with reference to the annexed schematic drawings representing, by way of non-restrictive examples, several preferred embodiments of the invention in which:

FIG. 2 is a partial longitudinal cross-sectional view of the fixing device of FIG. 1 in the position for being put on;

DETAILED DESCRIPTION OF THE INVENTION

Figure 1:
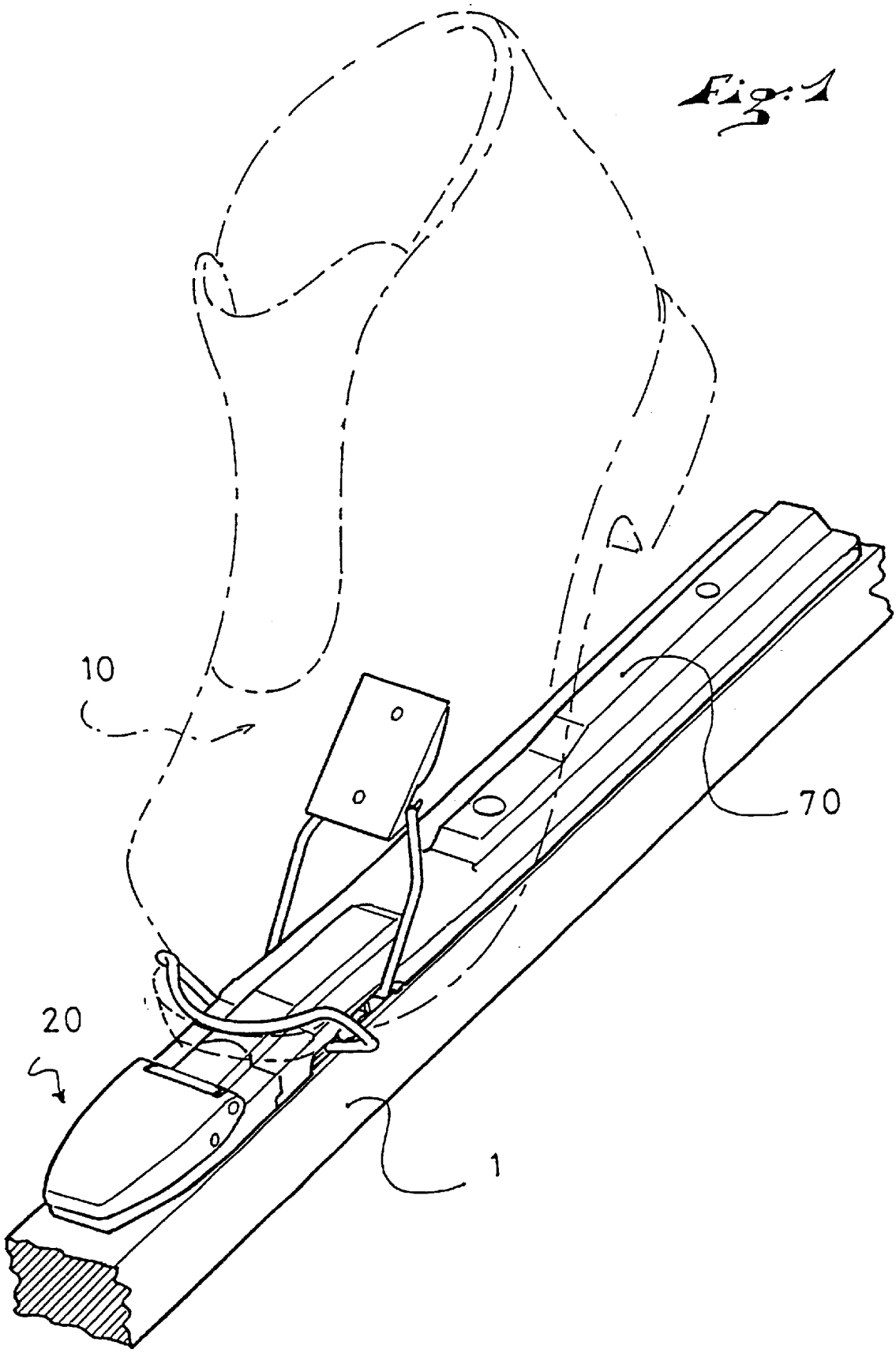
FIG. 1 is a perspective view of a fixing device according to the invention during its operation.

FIG. 1 shows the application of the coupling system, i.e., binding, according to the invention at the coupling of a ski 1 with a cross-country ski shoe 10, such coupling occurring by way of a fixing device 20 and a guiding rib 70.

Figure 5:
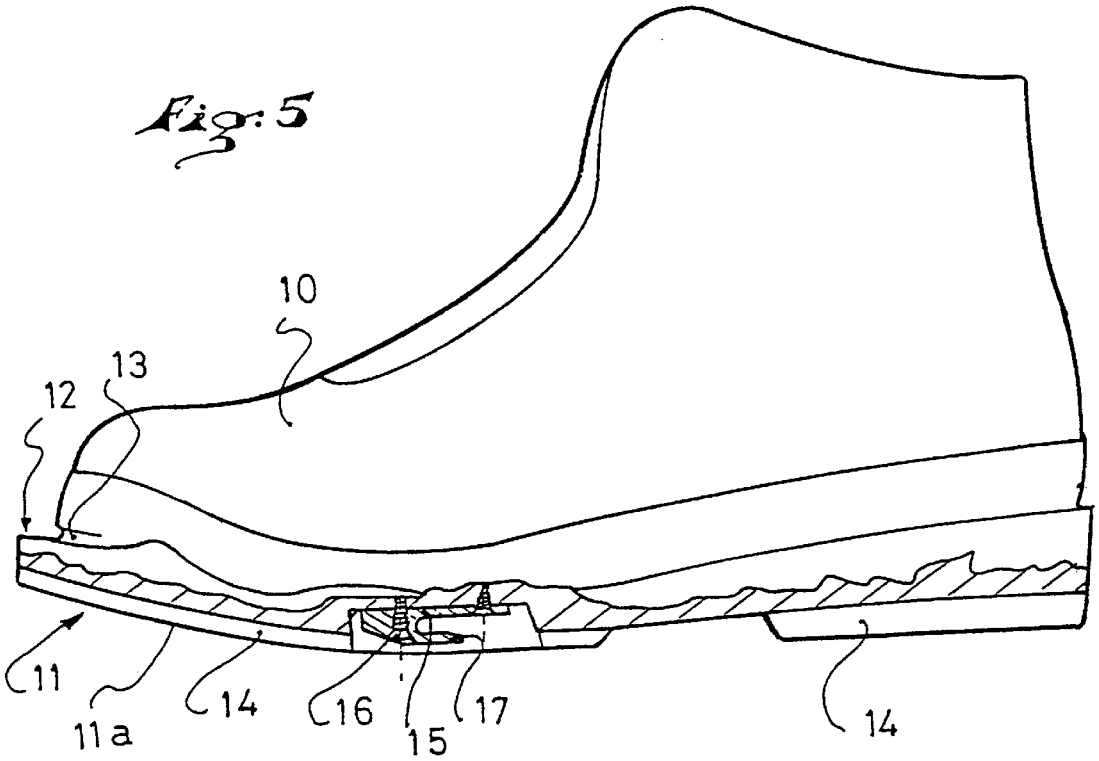
FIG. 5 is a partial cross-sectional view of the shoe lower part.

As shown in FIG. 5, the shoe 10 comprises a sole 11, equipped at its front end with a wide peripheral edge 12 that defines, at its joining with the shoe upper, a neck 13, and comprises along the entire length of its lower surface a median longitudinal groove 14. At its front end, the sole 11 curves upwardly in a slight curvature 11*a*, in the manner of traditional mountaineering shoes. The curve 11*a* is adapted to facilitate the movement of the shoe, as explained below.

Furthermore, an insert 15 is fixed, for example, by screws 16 or even by co-extrusion, to the base of the groove 14, in a zone corresponding substantially to the metatarsophalangian joint zone. This insert 15 defines a hook 17 oriented towards the rear.

All these shoe elements are adapted to cooperate with the fixing device 20 as explained below.

Figure 2:
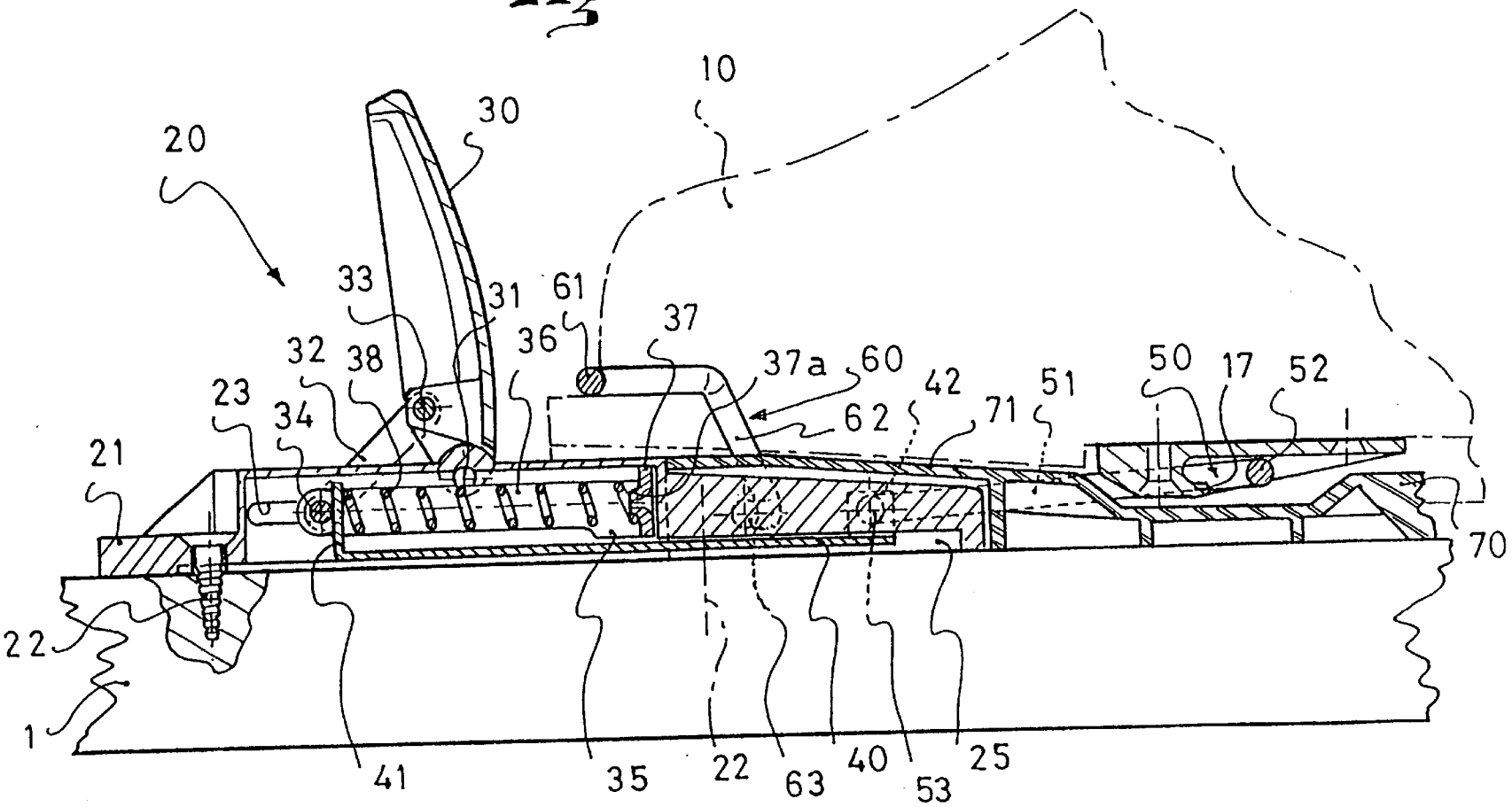

As shown in FIG. 2, the fixing device 20 is constituted of a seating 21 fixed on the ski 1 by screws 22, and on which is journalled a latching lever 30, about an axis 31. Moreover, the latching lever 30 is connected to the seating 21 by two lateral connecting rods 32, journalled, on the one hand, at 33 on the lever 30 and at a transverse axis 34 sliding in the lateral slots 23 of the seating, on the other hand.

The lever 30-connecting rods 32 assembly forms a knuckle joint system whose neutral line is defined by the axes 31 and 34.

Thus, when the lever 30 is lowered into the closed position shown in FIGS. 3 and 4, the journal axes 33 of the connecting rods 32 at the lever pass below the neutral line and the position of equilibrium is stable. The knuckle joint system requires a certain force to cross the axis 33 on both sides of the neutral position, and this guarantees that the lever will not open in an ill-timed manner.

A substantially cap shaped slide 35, comprising two longitudinal walls 36 and a base wall 37 is also mounted on the transverse axis 34. This slide 35 receives a compression spring 38.

The spring 38 is kept between the base 37 of the slide, which comprises a projection 37*a* adapted for this purpose, and the front end 41 of a carriage 40. The carriage 40 is slidably mounted in the seating 20 which comprises, to this end, a guiding slide 25 opening laterally along the sides of the seating 20. An elastic catching wire 50 adapted to cooperate with the shoe hook 17 is journalled at the rear end 42 of the carriage 40.

The elastic catching wire 50 is substantially U-shaped and comprises a transverse arm 52 adapted to cooperate with the hook 17 and two lateral arms 51 whose curved ends 53 are journalled on the carriage 40.

The fixing device also comprises a front stop, or stop mechanism, incidentally constituted of a stirrup 60 comprising a horizontal arm 61 shaped in a circular arch and corresponding to the shape of the neck 13 of the shoe sole, and adapted to receive the latter and two lateral arms 62, that are substantially vertical and journalled by their ends 63, on the seating 20. The stirrup 60 is arranged at the front of the elastic catching wire 50 and can therefore pivot about its ends 63.

Other shapes could be envisioned for the stirrup depending on the shape of the sole.

The stirrup could also be provided not to cooperate with the sole neck 13, but only with the upper surface of the peripheral edge 12.

Finally, the fixing device comprises a guiding rib 70 whose transverse section corresponds to that of the shoe groove 14 and whose front end 71 is adjusted to the rear part of the seating 20 which also forms a guiding rib.

The fixing system according to the invention works as follows. The shoe 10 is positioned in the fixing device by introducing its sole front end in the stirrup 60 until the neck 13 comes into abutment with the horizontal arm 61 of the stirrup (see FIG. 2).

Figure 3:
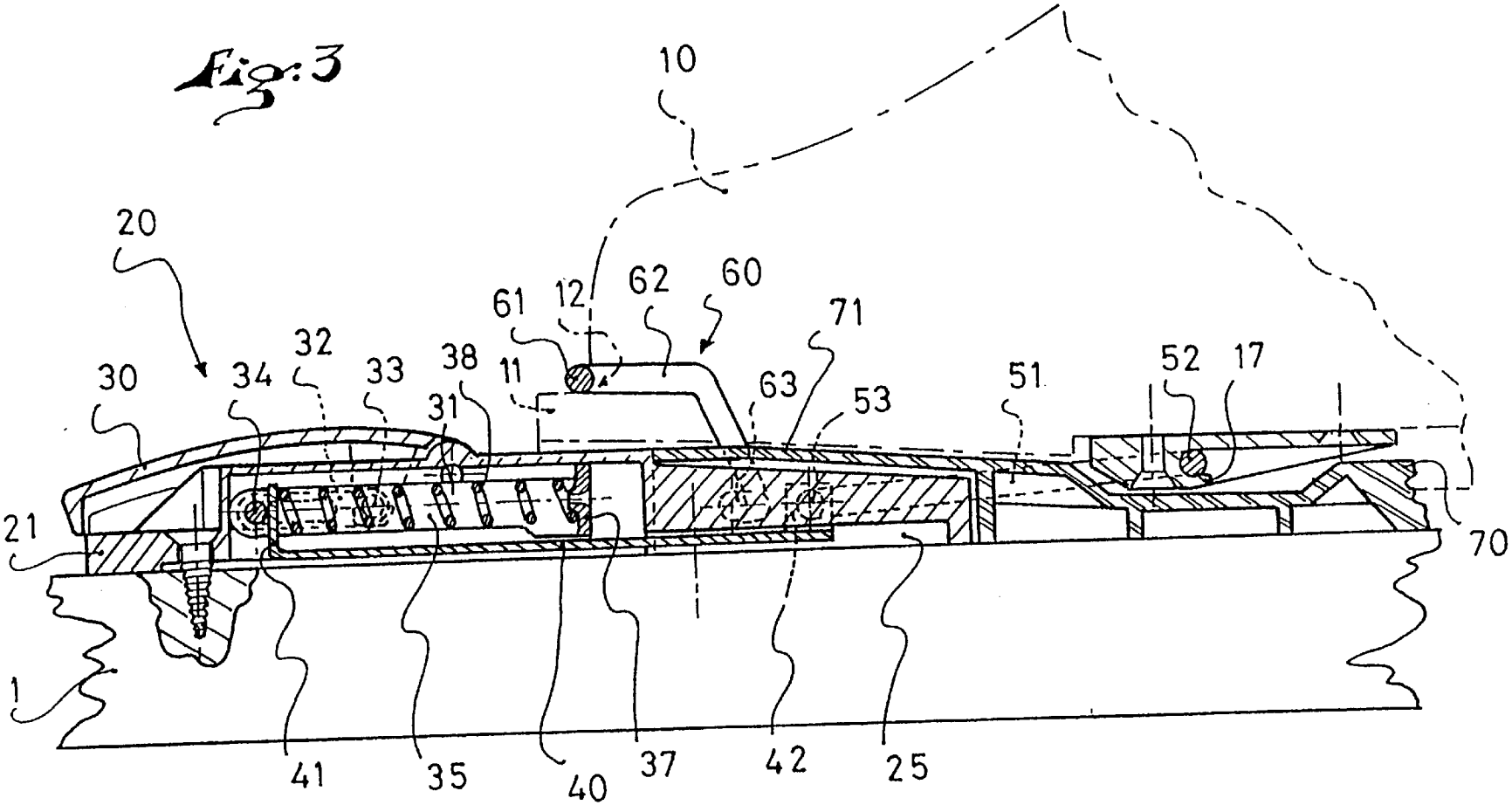
FIG. 3 is a view similar to FIG. 2, in the closed position, when the shoe is at rest.

The shoe therefore becomes latched by lowering the lever 30, which has the effect of pulling the carriage 40 and therefore the catching wire 50 towards the front until its arm 52 becomes housed in the base of the hook 17 (see FIG. 3).

This closing movement is assisted by the spring 38 which tends to push the carriage 40 back towards the front. The spring 38 also allows compensating for the snow wedges that could be formed in the shoe sole.

Figure 4:
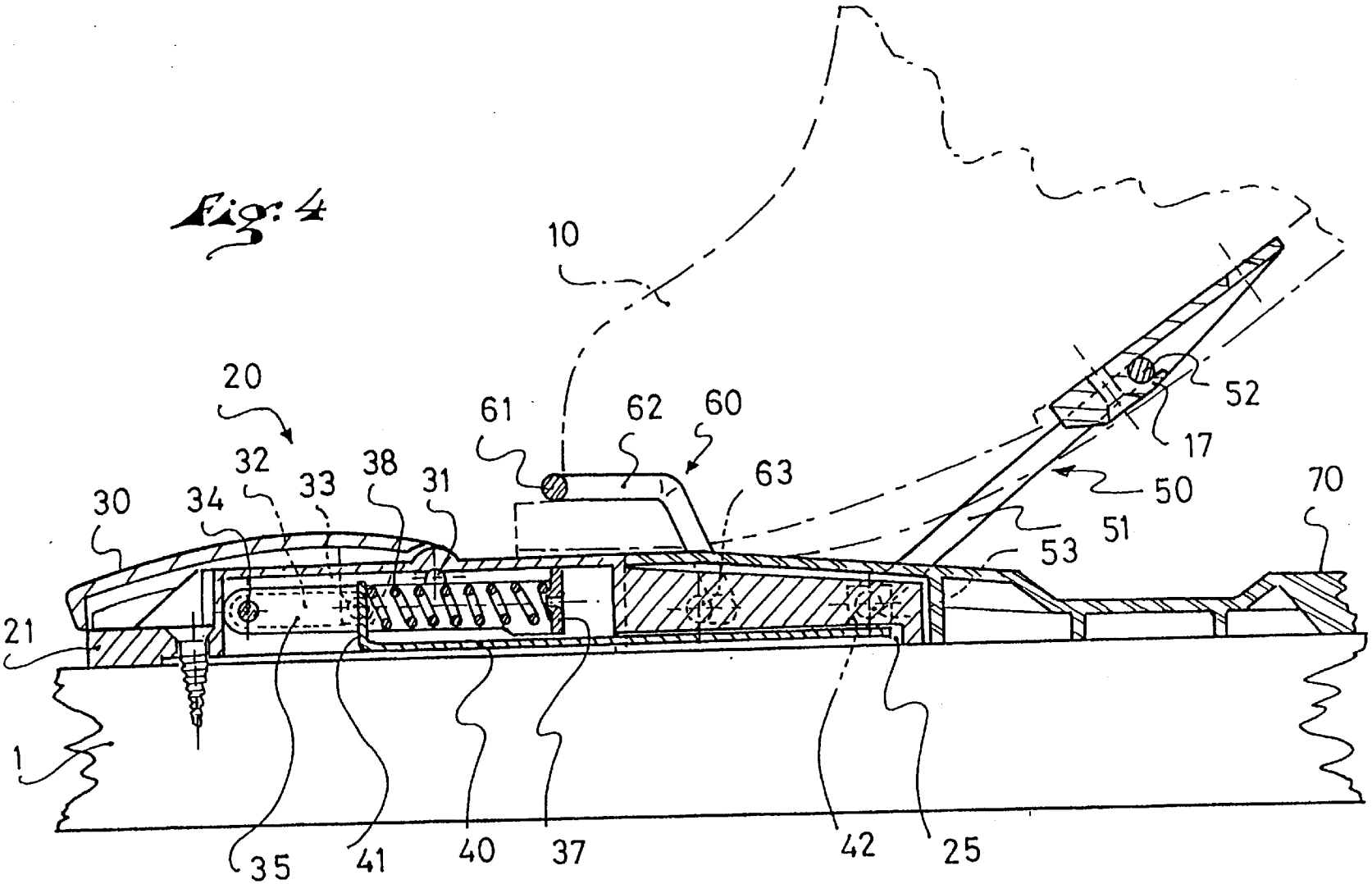
FIG. 4 is a view similar to FIG. 3 when the shoe is in the raised position.

While skiing, the shoe, whose heel remains free, can bend, carrying the catching wire 50 along its path, which both slides towards the rear into the seating 20 by compressing the spring 38 by means of the carriage 40, as well as pivots towards the top about its ends 53 (see FIG. 4).

The spring 38 therefore provides the return energy of the shoe towards the upper surface of the ski since it tends to relax, and therefore returns the catching wire 50 towards the front.

The return energy is therefore not provided by an elastic deformation of the wire 50 which therefore ages much better.

Furthermore, this return energy is completely defined since it is provided by the compression of a compression spring 38 and is better controlled and better controllable than would have been the case if it had been provided by the bending of a wire, as in the prior art.

In addition, the displacement, towards the rear with respect to the front stop mechanism 60, of the anchor 53 of the spring wire provides a triangulation, enabling a better retention of the shoe, especially in the transverse direction.

This triangulation, and especially the journalled anchoring of the catching wire 50 by its ends 53, also allows for a greater bending clearance of the shoe, a property desired in cross-country skis.

It should be noted that the journalled anchoring of the stirrup 60 on the seating 20, combined with the rounded shape 11*a* of the sole front, enabling a slight pivoting thereof towards the front when the shoe pivots, therefore allows it to accompany the motion of the movement of the shoe at the end of a stride, and therefore increases the amplitude of the stride even further. In practice, an increase on the order of 10 to 15° of the clearance of the shoe at the end of a stride can be obtained due to the rounded shape 11*a* of the sole thereof towards the front, which is especially interesting.

Finally, the presence along the entire length of the shoe sole, of the guiding rib 70, which is extended by the rear portion of the seating 21 up to the shoe front end, allows controlling the movement of the shoe until the motion ends, by providing it with a support and an abutment in the transverse direction.

As can be seen especially from FIG. 1, the guiding rib 70 is interrupted in the metatarsal zone for the passage of the catching wire 50 and the shoe associated hook.

The shapes of the guiding edges are designed also to optimize the guidance of the shoe.

Figure 6:
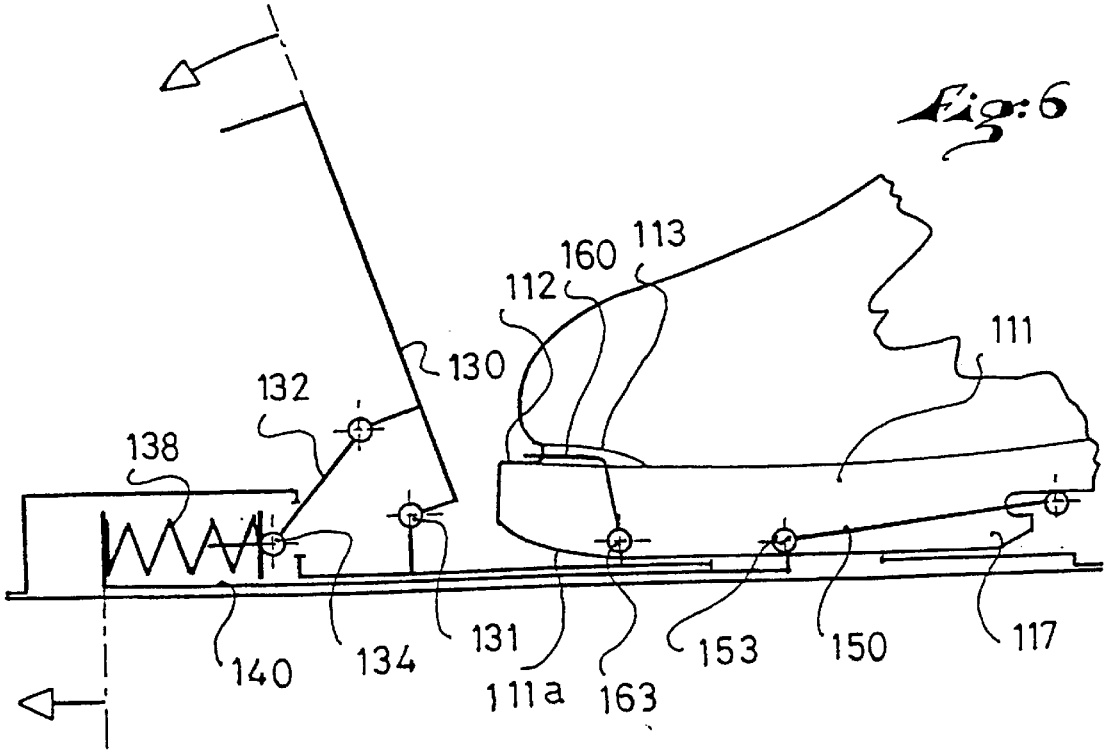
FIG. 6 is a schematic view of another embodiment during the closure of the fixing device.

FIG. 6 is a schematic illustration of a second embodiment in which similar or identical elements have been designated by the same references increased by 100.

In fact, this fixing system comprises the same latching elements or, in other words, a front stop stirrup 160, journalled at 163, a catching wire 150 connected to a slidably mounted carriage 140, which is biased towards the front by a spring 138 and whose longitudinal displacement is controlled by a lever 130.

The main difference lies in the position of the journals 131 and 134 of the lever 130 and the connecting rods 132 that are located at the rear of the spring 138. Otherwise, the operation is identical.

The instant invention is not limited to the embodiments described hereinbefore by way of non-restrictive examples, and can encompass all similar or equivalent embodiments.

What is claimed is:

1. A system for binding a shoe to a sports gear, said binding system comprising:

a fixing device to be fixed on the sports gear and comprising a front stop, adapted to cooperate with a front end of a shoe, and a catch, adapted to cooperate with an associated catching mechanism arranged behind a front end of a sole of the shoe and exerting on the sole a tension force directed towards said stop;

said catch being anchored on said fixing device by an anchoring mechanism located rearward of said front stop, said anchoring mechanism providing a journal connection between the catch and the device, to thereby relieve said catch of bending forces relative to a non-journalled connection, said catch being movable between a raised position of the shoe and a lowered position of the shoe; and said binding system further comprising an elastic mechanism for applying an elastic force in a direction opposing movement of said elastic catch from said lowered position to said raised position, and said anchoring mechanism being longitudinally movable countering said elastic force of said elastic mechanism.

2. A binding system according to claim 1, wherein:

said catch comprises a U-shaped element comprising a transverse arm to cooperate with the associated catching mechanism of the shoe.

3. A binding system according to claim 1, wherein:

said front stop is constituted by a stirrup to cooperate with a sole of the shoe.

4. A binding system according to claim 3, wherein:

said stirrup comprises a horizontal arm shaped substantially in a circular arc.

5. A binding system according to one claim 3, wherein:

said stirrup is journalled on said device to be fixed on the sports gear.

6. A binding system according to claim 1, wherein:

said device to be fixed on the sports gear comprises a longitudinally extending guide rib to cooperate with a corresponding groove of the shoe.

7. A binding system according to claim 1, wherein:

said catch is anchored on said fixing device by said journal connection at a front end of said catch.

8. A system for binding a shoe to a sports gear comprising:

a fixing device to be fixed on the sports gear and comprising a front stop, adapted to cooperate with a front end of a shoe, and a catch, adapted to cooperate with an associated catching mechanism arranged behind a front end of a sole of the shoe and exerting on the sole a tension force directed towards said stop;

said catch being anchored on said fixing device by an anchoring mechanism located rearward of said front stop, said anchoring mechanism providing a journal connection between the catch and the device, to thereby relieve said catch of bending forces relative to a non-journalled connection, said catch being movable between a raised position of the shoe and a lowered position of the shoe;

said binding system further comprising an elastic mechanism for applying an elastic force in a direction opposing movement of said elastic catch from said lower position to said raised position, and a knuckle-joint lever system for controlling a longitudinal movement of said anchoring mechanism.

9. A system for binding a shoe to a sports gear in combination with the shoe comprising:

a fixing device to be fixed on the sports gear and comprising a front stop, adapted to cooperate with a front end of a shoe, and a catch, adapted to cooperate with an associated catching mechanism arranged behind a front end of a sole of the shoe and exerting on the sole a tension force directed towards said stop;

said catch being anchored on said fixing device by an anchoring mechanism located rearward of said front stop, said anchoring mechanism providing a journal connection between the catch and the device, to thereby relieve said catch of bending forces relative to a non-journalled connection;

wherein said shoe comprises said catching mechanism, in the form of a hook, on a lower surface of said sole of said shoe.

10. A binding system and shoe according to claim 9, wherein:

said hook is fixed to said sole of said shoe in a metatarsophalangian joint zone.

11. A binding system and shoe according to claim 9, wherein:

said sole of said shoe comprises a front end with a peripheral edge having a shape to cooperate with a shape of said front stop.

12. A binding system and shoe according to claim 9, wherein:

said sole of said shoe comprises a front end with a peripheral edge having a neck shaped to cooperate with a shape of said front stop.

13. A binding system and shoe according to claim 9, wherein:

said sole of said shoe comprises a downwardly open longitudinal groove along an entire length of a lower surface of said sole.

14. A binding system and shoe according to claim 9, wherein:

said sole comprises a lower walking surface having an upwardly curved front end.

15. A system for binding a shoe to an article of a gliding sport to allow movement of the shoe with respect to the gliding sport article, said binding system comprising:

a longitudinally extending device to be fixed onto the gliding sport article;

a front stop connected to said device to secure a front end of a shoe to the gliding sport article during practice of said gliding sport;

an elastic mechanism comprising a carriage mounted for longitudinal movement with respect to said device and an elastic element constrained to apply a forwardly directed elastic force to said carriage;

a catch to be secured to the shoe rearward of the front end of the shoe, said catch being journalled to said carriage, rearward of said front stop, to thereby relieve said catch of bending forces relative to a non-journalled connection.

16. A binding system according to claim 15, wherein:

said front stop is connected to said device at a journal connection forward of said journal connection of said catch.

17. A binding system according to claim 15, wherein:

said catch has a longitudinal extent sufficient for being secured to a metatarsophalangian joint zone of the shoe.

* * * * *